US006966457B1

(12) United States Patent
Torbet

(10) Patent No.: US 6,966,457 B1
(45) Date of Patent: Nov. 22, 2005

(54) SPRING-LOADED TUBE SQUEEZING DEVICE

(76) Inventor: Eric Torbet, P.O. Box 1452, Goleta, CA (US) 93116

( * ) Notice: Subject to any disclaimer, the term of this patent is extended or adjusted under 35 U.S.C. 154(b) by 0 days.

(21) Appl. No.: 10/752,728

(22) Filed: Jan. 8, 2004

(51) Int. Cl.[7] ..... B65D 35/28
(52) U.S. Cl. ..... 222/102; 222/101
(58) Field of Search ..... 222/102, 101, 222/98, 95

(56) References Cited

U.S. PATENT DOCUMENTS

| | | | | |
|---|---|---|---|---|
| 11,497 A | * | 8/1854 | Farris | 431/206 |
| 1,773,104 A | | 9/1930 | Johnson | |
| 3,414,166 A | * | 12/1968 | Martin | 222/102 |
| 3,586,213 A | | 6/1971 | Gill | |
| 4,405,062 A | | 9/1983 | Tschida, Sr. | |
| 5,118,011 A | * | 6/1992 | Kopp | 222/102 |
| 5,495,801 A | * | 3/1996 | Dankert | 101/348 |
| 2002/0011497 A1 | * | 1/2002 | Farris | 222/102 |

FOREIGN PATENT DOCUMENTS

| | | | | |
|---|---|---|---|---|
| GB | 2052434 A | * | 1/1981 | B65D 35/28 |

* cited by examiner

*Primary Examiner*—Michael Mar
*Assistant Examiner*—Sonia N. Khaira

(57) ABSTRACT

A device for squeezing various household collapsible tubes comprises two lever handles, two pintles, two torsional springs, a primary roller, and a secondary roller. The lever handles are held together by and are free to rotate about the two pintles, forming a double non-crossing class 1 lever arrangement. The rollers, held in gudgeons by snap fit, are also free to rotate. The primary roller is distinguished from the secondary roller by having a crank at one end. The torsional springs, anchored by the pintles, provide a torque which causes the two rollers to clamp together. Operation of the tube squeezing device proceeds by inserting the crimped end of a collapsible tube between the rollers and turning the crank, thereby turning the rollers so as to squeeze the tube flat and to push its contents toward the nozzle end. Insertion and extraction of the tube is effected most readily by applying a compressive force to the two lever handles, creating a gap between the rollers for the tube to easily pass through.

9 Claims, 2 Drawing Sheets

SPRING-LOADED TUBE SQUEEZING DEVICE

BACKGROUND

1. Field of Invention

This invention relates generally to devices for squeezing and expelling the contents of collapsible tubes, and specifically to such devices having rollers and being small and economical in construction.

2. Description of Prior Art

Thin-walled collapsible tubes have long been popular as containers for items such as toothpaste, cream, and other paste-like materials. A great number of devices have been invented to squeeze and expel the contents of such tubes. Many of these suffer, however, from being excessively complex and uneconomical to produce.

Some simple devices work by winding the tube with a key, but these do not function well with plastic tubes which are resilient and tend to unwind. Furthermore, most devices of this type have the added inconvenience of requiring the tube to be subsequently unwound in order to disengage the key from the tube.

Other devices expel the tube contents without requiring the tube to be wound. The simplest of these is a block with a through-going slit into which the tube is inserted. The user pushes the block toward the nozzle end to flatten the tube and expel the contents. A major disadvantage of this type of device, however, is that the slit width is fixed and therefore not appropriate for all tube wall thicknesses.

Still other devices utilize one or more rollers to perform the squeezing action. The primary advantage of squeezing by a rolling rather than sliding action is that inherently less force is required to advance the device forward. U.S. Pat. No. 3,586,213 to John B. Gill (22 Jun. 1971) presents a device with two toothed rollers and two U-shaped handles. As the handles are manually squeezed together the rollers are brought to bear on the tube, and as one of the rollers is turned with a crank the tube is squeezed and crimped, and the device advances forward. The amount of squeezing pressure that can be applied to the tube is limited only by the strength of the user and ultimately by the strength of the device itself, and as such very stiff tubes such as those made purely of metal and containing very viscous contents can be effectively squeezed. However, the device does not function well with plastic tubes which due to their resiliency are not amenable to crimping, and thus back-flow of the tube contents can occur if the handles are released. Additionally, the teeth of the rollers can cause tears in plastic tubes if excessive force is applied. A further disadvantage of the device of Gill, true for all types of tubes squeezed, is that the user must continuously squeeze the handles together as the device advances forward, a fact which may cause difficulty or be an inconvenience for some individuals.

U.S. Pat. No. 1,773,104 to Stanley G. Johnson (19 Aug. 1930) presents a device which also employs two rollers to squeeze the tube, but the squeezing action is carried out by springs rather than by manual pressure. Although the user is alleviated of the task of squeezing, no easy means of advancing the device forward is provided. The user is expected to hold the tube with one hand, and with thumb and forefinger turn the two knurled rollers. A further disadvantage of this device is that no means of opening the rollers to allow the tube to be inserted is provided. Moreover, once the contents of the tube have been expelled, the lack of means of opening the rollers requires that, as with the devices employing keys, the device must be operated in reverse in order to be disengaged from the tube.

U.S. Pat. No. 4,405,062 to Eraine J. Tschida, Sr. (20 Sep. 1983) presents a device with two opening levers, two elastic bands, and two roller-shaped jaws. When the levers are squeezed, the jaws open, thereby permitting insertion or extraction of the tube. When not being squeezed, the levers, with the aid of the elastic bands, clamp down against the tube, thereby preventing back-flow of tube contents. Despite these advantages, this device still suffers from requiring the user to manually compress the jaws together in order to squeeze the tube and push the contents forward. Additionally, because the levers and the jaws look similar, there is the possibility of confusing the orientation of the device.

U.S. Pat. No. 3,414,166 to Paul G. Martin (3 Dec. 1968) and UK patent application GB 2,052,434 A to Rodney W. Park (28 Jan. 1981) both present wall-mounted devices which employ rollers and springs to squeeze the collapsible tube. Both of these devices suffer, though, from being overly large and consisting of many parts, and are therefore not of economical construction. Additionally, neither device provides a means of separating the rollers, which would permit rapid tube insertion and extraction. Finally, the device of Park suffers additionally from requiring a ratchet mechanism or a gravity-assisted arrangement to advance forward along the collapsible tube, both of which add greater complexity.

OBJECTS AND ADVANTAGES

Accordingly, several objects and advantages of the present invention are to provide a portable tube squeezing device which is of simple and economical construction, for which the tube can be inserted and extracted quickly and easily, which alleviates the user of the need to manually squeeze the tube, which retains a clamped position along the tube thereby preventing back-flow of tube contents, which requires relatively little force to advance forward along the tube, which smoothly flattens the tube in an aesthetically pleasing manner, which can be operated by left- or right-handed users, and which, with the exception of very stiff metal tubes, works well with the majority of household tubes on the market, including those made of resilient plastic.

Still further objects and advantages will become apparent from a consideration of the ensuing description and accompanying drawings.

REFERENCE NUMERALS

Figure 1:
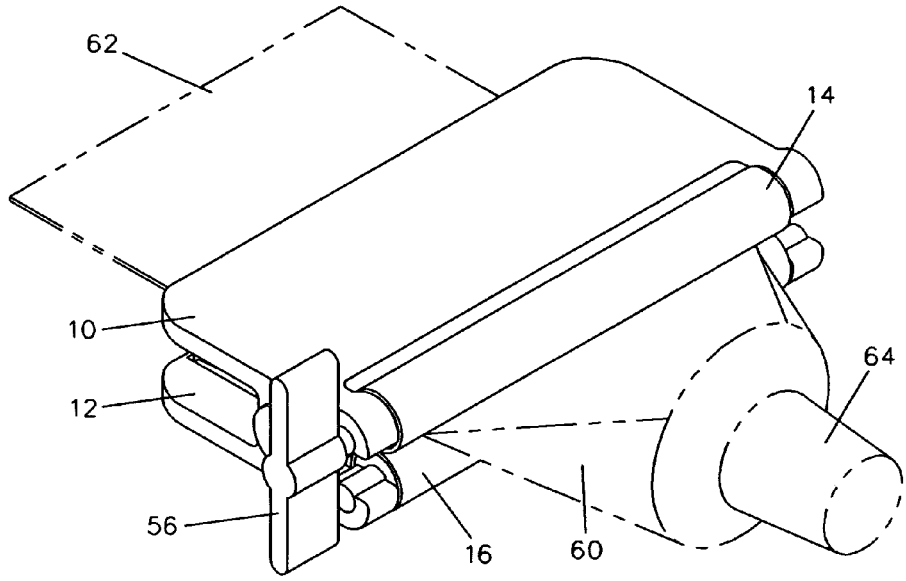
FIG. 1 shows a perspective view of the tube squeezing device, along with a collapsible tube drawn in phantom.

10 lever handle
12 lever handle
14 primary roller
16 secondary roller
18 pintles
20 torsional springs
30 shackle
32 shackle
34 pintle hole
36 pintle hole

38 saddle
40 gudgeons
42 protuberances
44 alignment grooves
50 rod
52 trunnion
54 trunnion
56 crank
58 friction sheath
60 collapsible tube
62 crimped end
64 nozzle end

SUMMARY

The present invention is a device for squeezing collapsible tubes comprising two opposed lever handles of hand-held size, a primary roller, a secondary roller, means for rotatably connecting the lever handles to form a double non-crossing class 1 lever arrangement such that the inward facing surfaces of the lever handles are approximately parallel and sufficiently separated to pass a flattened collapsible tube, means for rotatably attaching the rollers to the lever handles such that the rollers are parallel and adjacent, actuating means for rotating the primary roller and thereby advancing the device along a collapsible tube, and spring means for providing a torque which compels the lever handles to pivot in a direction which bears the rollers together with a force sufficient to squeeze, flatten and expel the contents of a collapsible tube.

PREFERRED EMBODIMENT—DESCRIPTION

Figure 2:
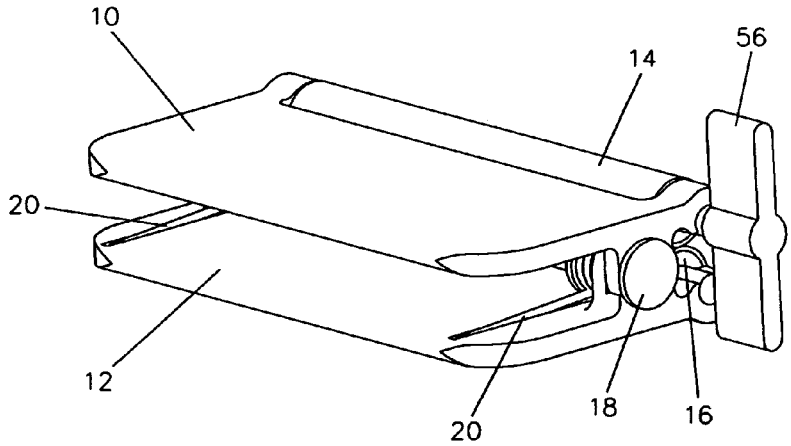
FIG. 2 shows another perspective view of the tube squeezing device.

FIG. 1 shows a perspective view of a preferred embodiment of the tube squeezing device, along with a collapsible tube 60 with a crimped end 62 and a nozzle end 64 drawn in phantom and inserted in the proper orientation for use. FIG. 2 shows the tube squeezing device alone from a different perspective angle. Referring now to these two figures, the tube squeezing device consists of two identical opposed lever handles 10 and 12, attached together by two pintles 18. Only one pintle is shown in the figures, the other one being in mirror opposition to the one shown. Lever handles 10 and 12 are free to rotate about pintles 18. Pintles 18 additionally serve as pivots or anchors for two torsional springs 20. These springs have arms extending onto lever handles 10 and 12 for leverage. In the orientation of lever handles 10 and 12 shown in these figures, the arm extensions of torsional springs 20 are approximately parallel and the springs are in a torqued state. Forward of the pintles, attached to lever handle 10 by snap fit is a primary roller 14, and attached to lever handle 12 also by snap fit is a secondary roller 16. Both rollers 14 and 16 are free to rotate. Primary roller 14 is distinguished from secondary roller 16 by having a crank 56 at one end.

Placement of the rollers forward of the pintles creates a double non-crossing class 1 lever arrangement. A class 1 lever is conventionally defined as a lever for which the points of effort and load are located on opposite sides of the fulcrum. Non-crossing signifies that the two lever arms do not cross at the fulcrum. Pintles 18 are the fulcrum, rollers 14 and 16 located forwardly of the pintles are the point of load, and the end sides of lever handles 10 and 12 located rearwardly of the pintles are the point of effort of the lever arrangement.

Figure 3:
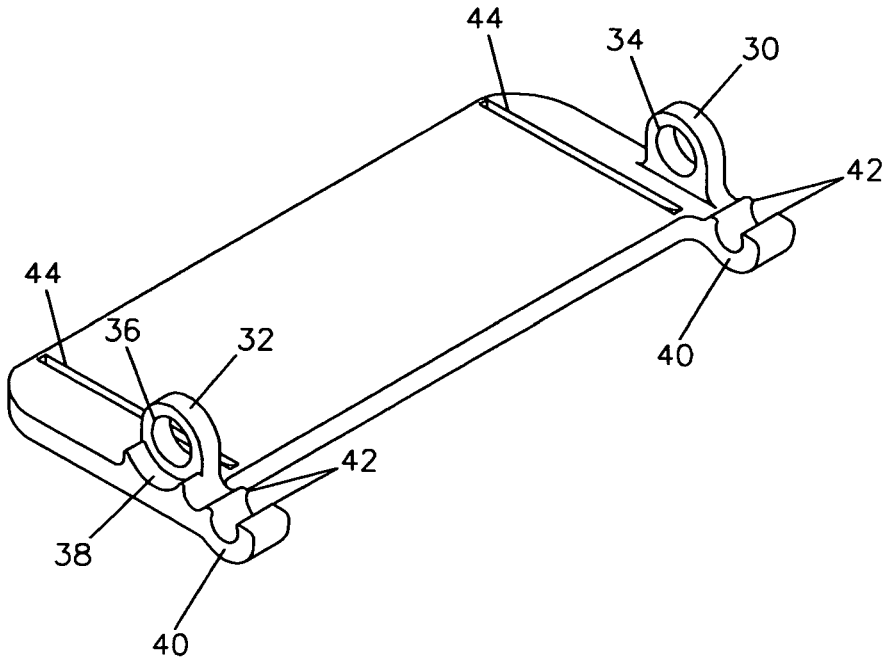
FIG. 3 shows a perspective view of one lever handle.

FIG. 3 shows a perspective view of one of the two identical lever handles 10 or 12. The lever handle can be made of any rigid non-brittle material, for example certain plastics such as nylon, rigid PVC or acetal. If one of these types of plastic is used, then the thickness of the lever handle should be about 3 mm. If it is too thin, then it may break or deform excessively under the combined forces of torsional springs 20 and of the user's fingers. If it is too thick, then the amount of plastic used is excessive and uneconomical.

As shown in FIG. 3, located on the sides of the lever handle are two shackles 30 and 32 with pintle holes 34 and 36 respectively. The relative separation of shackles 30 and 32 should be wide enough to accommodate most household collapsible tubes. Adjacent to the outside face of shackle 32 is a saddle 38. Lever handles 10 and 12 are placed in opposition, with shackle 30 of lever handle 10 in saddle 38 of lever handle 12 and shackle 30 of lever handle 12 in saddle 38 of lever handle 10, and with pintle hole 34 of lever handle 10 aligned with pintle hole 36 of lever handle 12 and pintle hole 34 of lever handle 12 aligned with pintle hole 36 of lever handle 10. With lever handles 10 and 12 in this position, pintles 18 are inserted through the pintle holes, thereby holding the two lever handles together. Pintles 18 are binding screws or compression rivets whose shanks are sufficiently smooth and round to permit free rotation of lever handles 10 and 12. Pintles 18 additionally have heads at each end to keep the pintles in place.

Pintles 18 additionally serve as pivots for the two torsional springs 20. The cylindrical body of each spring is placed on each pintle and positioned between the inside face of shackle 32 and the head of the pintle. The springs have straight arms which extend against lever handles 10 and 12. Each lever handle has two alignment grooves 44 into which the torsional spring arms lie. The length of the spring extension arms should be about 25 mm. If the length is much less than this, then the spring arms do not have a comfortable leverage with which to exert pressure against the lever handles. If the length is greater than this, then the size of the lever handles must increase, adding unnecessary material and cost. Each torsional spring should be fabricated so that the angle between its two arms, when the spring is relaxed, is greater than about 45 degrees. For angles less than this, the torque exerted by the springs varies too rapidly between the two extreme rotational positions of the lever handles. In the extreme closed rotational position of the lever handles shown in FIGS. 1 and 2, the two torsional springs 20 should produce a combined torque of about 0.5 N-m. A torque much less than this does not adequately squeeze most collapsible tubes, while a torque much more than this makes movement of the lever handles difficult to the user.

As also shown in FIG. 3, located on the sides of the lever handle forward of the shackles are two gudgeons 40, which serve to hold the two rollers 14 and 16 and allow them to freely turn. The gudgeons hold the rollers by snap fit in order to facilitate assembly. The snap fit is achieved by way of protuberances 42, that is small amounts of over-hanging material at the entrance of the gudgeon where the roller is inserted.

Figure 4:
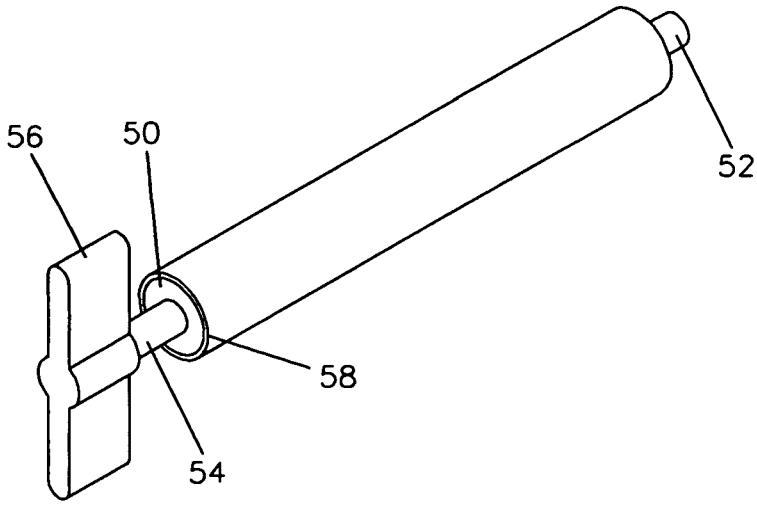
FIG. 4 shows a perspective view of the primary roller.

FIG. 4 shows a perspective view of primary roller 14, which comprises a rod 50, two trunnions 52 and 54, a crank 56, and a friction sheath 58. The trunnions in particular lie in gudgeons 40. During assembly, the gudgeons, being sufficiently resilient, bend to allow the insertion of the trunnions past protuberances 42. Once the trunnions are fully inserted, the gudgeons return to their relaxed position, with the protuberances then serving to hold the trunnions in place, and the roller being free to rotate.

Attached to trunnion 54 is crank 56. Trunnion 54 is slightly longer than trunnion 52 because the crank must clear the head of pintle 18 as primary roller 14 turns. In the preferred embodiment, the rod, trunnions, and crank are all one piece of molded plastic, either acetal or rigid PVC, while the friction sheath is flexible PVC that is over-molded onto the rod, forming a chemical bond. The durometer of the flexible PVC is 40 to 60 on the Shore A scale, a durometer which results in a tacky surface. Secondary roller 16 is identical to primary roller 14 except that it has no crank 56 and its two trunnions are of the same length as trunnion 52 of primary roller 14.

Lever handles 10 and 12, shackles 30 and 32, and gudgeons 40 can be fabricated as a single piece of plastic by injection molding. To create pintle holes 34 and 36, the mold must have retractable side-pulls. Side-pulls may also be required to create protuberances 42. Rollers 14 and 16 are also most economically made by injection molding, however rod 50 and friction sheath 58 can alternatively be fabricated by extrusion or co-extrusion. In this case, pins, preferably metal and grooved, inserted into holes at the ends of the rods, would serve as the trunnions. Additionally, crank 56 would require a hole into which one end of the grooved trunnion would insert. However, rollers made in this fashion are not the preferred embodiment, as they are excessively complicated.

PREFERRED EMBODIMENT—OPERATION

Operation of the tube squeezing device begins by inserting crimped end 62 of partially emptied collapsible tube 60 between rollers 14 and 16. One way to achieve this is for the user to apply opposing compressive force directed near the end sides of lever handles 10 and 12 located rearwardly of pintles 18. By doing so, the lever handles pivot, one relative to the other, about pintles 18, in the manner of a double non-crossing class 1 lever, separating rollers 14 and 16 and thereby creating an opening into which the collapsible tube can be inserted. It is not necessary to rotate the lever handles to their extreme open rotational position, but rather only enough to comfortably pass crimped end 62 between rollers 14 and 16. The compressive force can be applied with the user's fingers or by resting one lever handle against a solid surface and pressing down with the palm of the hand onto the other lever handle. This compressive force is necessary to overcome the torque imposed by torsional springs 20.

Another way of inserting collapsible tube 60 between rollers 14 and 16 is to place crimped end 62 of the tube up against the rollers, as if to insert the tube, but because the rollers are closed together the crimped end merely makes contact with both rollers. The user then turns crank 56 in the direction which rolls primary roller 14 toward nozzle end 64 of the tube. The surface of friction sheath 58 is sufficiently tacky that the tube will then be pulled between the rollers. This latter method of inserting collapsible tube 60 into the tube squeezing device alleviates the user of the need to exert any compressive force, if that is their desire. The only effort required is the turning of crank 56, which because it involves a rolling action is not difficult.

Operation of the tube squeezing device continues by turning crank 56 in the direction which rolls primary roller 14 toward nozzle end 64 of collapsible tube 60. Nozzle end 64 may be capped or uncapped according to the preference of the user. Secondary roller 16 will also turn, owing to the friction between friction sheath 58 and collapsible tube 60. The tube will thereby be squeezed flat and its contents pushed forward toward nozzle end 64. If the user stops turning the crank, then owing to the clamping force provided by torsional springs 20 and the tacky grip provided by friction sheath 58, the rollers will maintain their position along the tube and not roll back unattended toward crimped end 62. Furthermore, if the user removes the cap from nozzle end 64 and manually squeezes the collapsible tube in order to expel a portion of the tube contents, then for most household tubes this action will also not cause the tube squeezing device to roll back toward crimped end 62 of the tube.

Operation of the tube squeezing device ends when the rollers have advanced as far forward as possible, and nearly all of the tube contents have been expelled from the tube. At this point, the tube is extracted from the tube squeezing device. To perform this extraction, the user can again apply opposing compressive force to lever handles 10 and 12, thereby separating the rollers and allowing for rapid tube extraction. Alternatively, for those users not wishing to apply this compressive force, crank 56 can simply be turned in reverse, in the direction which rolls primary roller 14 toward crimped end 62 of the tube, until the rollers are no longer in contact with the tube. The small amount of tube contents remaining in the tube near nozzle end 64 can be removed by the user with finger pressure or by other means.

Because primary roller 14 is held in gudgeons 40 by snap fit, it is manually possible for the user to reverse the orientation of primary roller 14, placing the crank 56 on a preferred side and thereby permitting left- or right-handed operation of the tube squeezing device. Finger pressure alone should suffice to extract and re-insert primary roller 14.

CONCLUSIONS, RAMIFICATIONS, AND SCOPE

Accordingly, it is apparent from the foregoing description that the tube squeezing device here presented has distinct advantages over much of the prior art. It is portable and of simple and economical construction. The compressive force required to squeeze the collapsible tube is provided by torsional springs, alleviating the user of this effort. The squeezing of the tube and the pushing forward of its contents occur by way of a rolling action, requiring only the turning of a crank. The tube is flattened in an aesthetically pleasing manner as a result of the squeezing process, unlike many prior art devices in which the tube is wound, crimped, or marred in some way. The tube squeezing device works well with most household tubes, including those made of resilient plastic.

Although the foregoing description contains many specificities, these should not be construed as limiting the scope of the invention but as merely providing illustrations of some of the presently preferred embodiments of this invention. Various other embodiments and ramifications are possible within its scope. For example, the tube squeezing device can be used to squeeze other items besides collapsible tubes, such as small food pouches. As a further example, friction sheath 58 can be eliminated completely, and rod 50 can be molded to have a rough or spiky surface. As a final example, torsional springs 20 can be replaced by compression springs, provided they are placed on lever handles 10 and 12 rearwardly of pintles 18.

Thus the scope of the invention should be determined by the appended claims and their legal equivalents, rather than by the examples given.

What is claimed is:

1. A device for squeezing collapsible tubes comprising:

(a) two opposed lever handles, of handheld size, each said lever handle having inward facing surfaces, (b) a primary roller, having a substantially cylindrical outer surface, (c) a secondary roller, having a substantially cylindrical outer surface, (d) means for rotatably connecting said lever handles to form a double non-crossing class 1 lever arrangement, said lever handles being positioned so that said inward facing surfaces are approximately parallel and sufficiently separated to pass a flattened collapsible tube therebetween, (e) means for rotatably attaching said primary roller to one of said lever handles and for rotatably attaching said secondary roller to the other of said lever handles, such that said rollers are substantially parallel and adjacent, (f) actuating means for rotating said primary roller and thereby advancing said device along a collapsible tube, (g) spring means for providing a torque which compels said lever handles to pivot in a direction which bears said rollers together with a force sufficient to squeeze and flatten a collapsible tube and expel the contents therefrom.

2. The device of claim 1 further including a friction sheath made of a tacky material individually covering said cylindrical outer surface of each said roller.

3. The device of claim 1 wherein the characteristic of said cylindrical outer surface of at least one said roller is selected from the group consisting of being knurled, being spiked, being roughened, and being ribbed.

4. The device of claim 1 wherein said means for rotatably connecting said lever handles comprises a shackle and pintle arrangement.

5. The device of claim 1 wherein said means for rotatably attaching said rollers to said lever handles comprises a trunnion and gudgeon arrangement.

6. The device of claim 5 further including protuberances located at the entrance of said gudgeons, creating a snap fit for said trunnions.

7. The device of claim 1 wherein said actuating means for rotating said primary roller comprises a crank attached to one end of said primary roller.

8. The device of claim 1 wherein said spring means for providing a torque comprises at least one torsional spring.

9. The device of claim 1 wherein said spring means for providing a torque comprises at least one compression spring.

* * * * *